United States Patent [19]

Stravitz

[11] 4,271,999

[45] Jun. 9, 1981

[54] GUITAR STRAP CONNECTOR

[75] Inventor: David M. Stravitz, New York, N.Y.

[73] Assignee: Ambico Inc., Lynbrook, N.Y.

[21] Appl. No.: 69,533

[22] Filed: Aug. 24, 1979

[51] Int. Cl.[3] ..... G10G 5/00

[52] U.S. Cl. ..... 224/257; 24/217 W; 24/224; 224/271; 224/910

[58] Field of Search ..... 224/257, 258, 271, 910; 84/327; 24/163 R, 194, 196, 200, 222 R, 223, 224, 230 AK, 230 AL, 217 W, 218

[56] References Cited

U.S. PATENT DOCUMENTS

| | | | |
|---|---|---|---|
| 2,122,138 | 6/1938 | Hansen | 24/218 X |
| 2,221,821 | 11/1940 | Strehlein | 24/224 R |
| 2,226,262 | 12/1940 | Roberts | 24/224 R |
| 2,246,852 | 6/1941 | Kale | 24/224 R |
| 2,966,356 | 12/1960 | Wilson et al. | 224/271 X |
| 3,583,042 | 6/1971 | Ishizaka | 24/223 R |
| 3,688,012 | 8/1972 | Vettel | 84/327 |
| 4,028,981 | 6/1977 | Cravens | 84/327 |
| 4,046,296 | 9/1977 | McGhee | 24/223 X |

*Primary Examiner*—Stephen Marcus

*Attorney, Agent, or Firm*—Frishauf, Holtz, Goodman and Woodward

[57] ABSTRACT

A guitar strap connector comprises a body member having a slot for connection of a guitar strap thereto; a generally keyhole-shaped opening in the body member, the keyhole-shaped opening comprising first and second holes having a passageway therebetween, the first hole being larger than the second hole; and a pair of resilient spring-like members integral with the body member and adjacent at least the passageway on respective opposite sides of the passageway, the spring-like members being bowed toward each other and each having a respective void space therebehind to permit the spring-like members to flex away from each other into the void spaces to permit a button connector of a guitar to be passed from the larger hole resiliently through the passageway and into the smaller hole wherein the button connector is engaged. Preferably, the body member is integrally formed of resilient plastic material such as polypropylene.

12 Claims, 2 Drawing Figures

GUITAR STRAP CONNECTOR

BACKGROUND OF THE INVENTION

This invention relates to a connector member for a guitar strap, or the like.

Guitars have a guitar strap button projecting therefrom, to which a guitar strap is connected. One known connector is illustrated, for example, in U.S. Pat. No. 3,688,012.

The object of the present invention is to provide a simplified, one-piece, easy-to-manufacture and easy-to-use guitar strap connector. A further object is to provide such a connector which may be inexpensively manufactured of plastic material, such as polypropylene, and which is suitable for use with virtually all guitar strap connector buttons presently in use.

SUMMARY OF THE INVENTION

A guitar strap connector of the present invention comprises a body member having connecting means for connection of a guitar strap thereto; a generally key hole-shaped opening in the body member, the key hole-shaped opening comprising first and second holes having a passageway therebetween, the first hole being larger than the second hole, and a pair of resilient spring-like members integral with the body memeber and adjacent at least the passageway on respective opposite sides of the passageway, the spring-like members being bowed toward each other and each having a respective void space therebehind to permit the spring-like members to flex away from each other into the void spaces to permit a button connector of a guitar to be passed from the larger hole resiliently through the passageway and into the smaller hole wherein the button connector is engaged.

Preferably, the body member is integrally formed of resilient plastic material, such as polypropylene. Polyethelene and nylon materials are also suitable.

DETAILED DESCRIPTION

Figure 1:
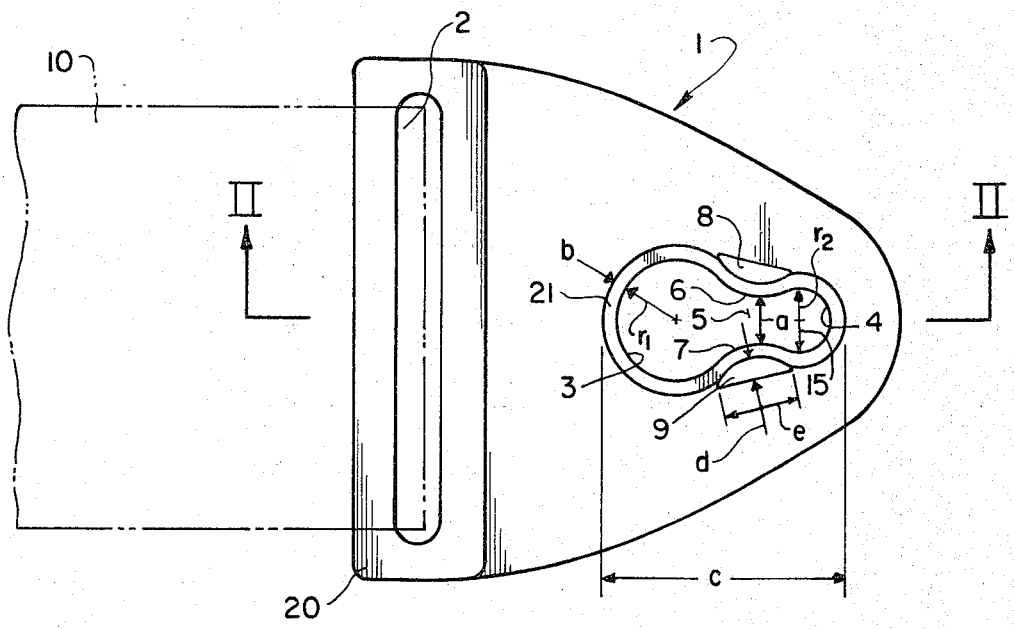
FIG. 1 is a plan view of a guitar strap connector of the present invention.

Referring to FIG. 1, a guitar strap connector of the present inventon comprises a preferably substantially flat body member 1 having an elongated slot 2 therein for engagement with a guitar strap 10. The guitar strap is only partially shown for ease of illustration. The guitar strap comprises two connectors, one at each end. However, only one connector is shown in the drawings.

The body member 1 has two holes 3, 4 formed therein with a passageway 5 between said holes. The holes 3, 4 are preferably generally circular in shape except for the portions leading to passageway 5. The holes 3, 4 and the passageway 5 form a generally keyhole-shaped opening in the body member 1. The diameter of the hole 3 is larger than the largest diameter of a button connector 11 (FIG. 2) of a guitar to which the connector is to be attached, so that hole 3 can pass over the button connector of the guitar. The diameter of the hole 4 is large enough so that it engages a minimum diameter portion 12 of the button connector 11 of the guitar, but is smaller than the maximum or outer diameter of the upper portion 13 (FIG. 2) of the guitar connector button so that upper portion 11 cannot pass through hole 4, whereby the connector may be positively engaged with the button connector 11 of the guitar.

The passageway 5 between holes 3, 4 is defined by resilient spring-like members 6, 7 which are bowed toward each other and which have void spaces 8, 9 therebehind. The void spaces 8, 9 are generally segments of a circle and may be, if desired, generally half-moon shaped. The resilient spring-like members 6, 7 are long enough so that they have sufficient flexibility to permit an object having a diameter approximately equal to the diameter of opening 4 to pass resiliently through the passageway 5. Also, the depth "d" of the void spaces 8, 9 is sufficient to permit sufficient flexing of the spring-like members 6, 7 away from each other to permit passage of such an object through passageway 5 and into opening 4. Spring-like members 6, 7 have smooth camming surfaces on both sides thereof (i.e. facing hole 3 and facing hole 4) to permit a button connector 11 to be smoothly passed in either direction through passageway 5 from one hole to the other.

Preferably, the body member 1 is integrally formed of polypropylene material. This material exhibits a high degree of strength and has excellent "living hinge" characteristics which provide excellent flexibility to hinge-like members 6, 7, while providing a high degree of strength so that excellent locking of the guitar connector button 11 in opening 4 is achieved. After passing of the guitar connector button through the passageway 5 (by forcing same past spring-like members 6, 7) and into opening 4, the spring-like members 6, 7 springingly return to their bowed-out condition as shown in FIG. 1 to reduce the size of passageway and to effectively lock the guitar connector button 11 in opening 4, thereby preventing inadvertent disengagement of the guitar from the guitar strap connector. Additionally, the polypropylene material prevents scratching or otherwise damaging of the guitar.

Other materials, such as polyethylene, nylon, etc. could be used, as desired.

Figure 2:
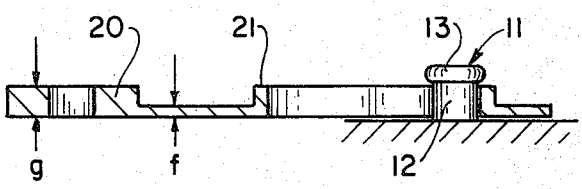
FIG. 2 is a cross-sectional view of the guitar strap connector of FIG. 1 taken along lines II—II, and illustrating a guitar button connector engaged therewith.

As seen in FIG. 1, the portion of the guitar strap connector 20 in the vicinity of the strap slot 2 is thickened to provide extra strength to this portion of the connector. Also, the area 21 around the holes 3, 4 and passageway 5 is thickened (as seen in FIGS. 1 and 2) to provide a more durable connector device. The thickening of this border portion of holes 3, 4 and passageway 5 also provide more strength to the spring-like members 6, 7 so that they may more securely retain a guitar connector button in opening 4. The area 21 defines a raised rim around the openings 3, 4 and passageway 5.

As seen in FIG. 1, it is preferable that the void spaces 8, 9 extend to a circumferential portion of opening 4 approximately adjacent the vertically directed diameter 15 shown in FIG. 1. This provides flexing of the spring-like members 6, 7 to permit an object having a diameter substantially equal to the diameter of opening 4 to be passed through passageway 5 since the spring-like member 6, 7 can flex to permit the passageway to be almost the same width as the diameter of opening 4. The degree of flexing of the spring-like members 6, 7 depends upon the material from which the connector member is made. With polypropylene, which is highly flexible and which has excellent "living hinge" characteristics, it has been found that the spring-like members 6, 7 can be flexed outwardly so that an object almost as large as the diameter of opening 4 can be passed through passageway 5.

The location of the extremities or end portions of the void spaces 8, 9 on the sides thereof adjacent opening 3 is not as critical as that on the right-hand side as seen in FIG. 1. The position illustrated in FIG. 1, wherein the left-hand extremities of the void spaces 8, 9 are located approximately midway between the vertical diameter of opening 3 and the place where the outer circumference of opening 3 would have been if passageway 5 was not present, has been found to be advantageous. By extending the length "e" of the void spaces 8, 9, the degree of flexibility of the spring-like members 6, 7 is increased. By increasing the flexibility of these members, the ability to lock a guitar connector button in opening 4 is reduced.

In a typical embodiment, the approximate dimensions listed below were used. It has been found that these dimensions provide excellent operational characteristics with guitar connector buttons 11 having shaft 12 diameters of from about 0.210 to about 0.226 inches.

$r_1$=0.260 inches
$r_2$=0.135 inches
a=0.200 inches
b=0.060 inches
c=1.100 inches
d=0.140 inches
e=0.500 inches
f=0.045 inches
g=0.125 inches Since the diameter of hole 4 ($2r_2$) is always larger than the diameter of shaft 12 of the guitar connector button 11, the connector 1 loosely confines the connector button 11 to permit substantially free rotating movement of connector 1 about connector button 11.

In the claims:

1. A one piece integrally formed guitar strap connector for engaging, retaining and loosely confining a pin-like button connector of a guitar, the pin-like button connector having a given diameter, comprising:

a body member (1) having connecting means (2) for connection of a guitar strap thereto;

a generally keyhole-shaped opening in said body member, said keyhole-shaped opening comprising first and second holes (3, 4) having a resilient restricting passageway 5 therebetween, said first hole (3) being larger than said second hole (4) and both of said holes being larger than said diameter of said pin-like button connector; and a pair of resilient spring-like members (6, 7) integral and unitary with said body member (1) and being located on respective opposite sides of said passageway (5) and defining said passageway (5), said spring-like members (6, 7) being bowed toward each other to form said resilient restricting passageway (5) therebetween, said passageway (5) having a width less than said diameter of said pin-like button connector, each spring-like member having a pair of smooth camming surfaces respectively facing both holes (3,4) and a respective void space (8,9) therebehind to permit said spring-like members to resiliently flex away from each other into said void spaces to permit a button connector of a guitar to be smoothly passed from the larger hole (3) resiliently through said restricting passageway (5) and into said smaller hole (4) wherein said button connector is engaged and retained without being wedged or otherwise restrained by said spring-like members (6,7), said button connector being loosely confined in said smaller hole (4) to permit substantially free rotating-type movement of the guitar strap connector about said pin-like button connector.

2. The guitar strap connector of claim 1 wherein said body member is integrally and unitarily formed of resilient plastic material.

3. The guitar strap connector of either of claims 1 or 2 wherein said body member is made of polypropylene.

4. The guitar strap connector of either of claims 1 or 2 wherein said body member is a substantially flat member.

5. The guitar strap connector of claim 1 wherein said void spaces (8, 9) are generally circular segments.

6. The guitar strap connector of either of claims 1 or 5 wherein said first and second holes are generally circular holes, the smallest dimension of said passageway between said spring-like members (6, 7) being smaller than the diameter of said second hole.

7. The guitar strap connector of claim 6 wherein said void spaces extend over a distance between said first and second holes and adjacent a circular portion of said first and second holes.

8. The guitar strap connector of claim 7 wherein said void spaces extend to substantially diametrically opposite portions of said second hole (3).

9. The guitar strap connector of claim 8 wherein said void spaces extend to a point adjacent said first hole which is between the generally vertically directed diameter of said first hole and the end portion of said first hole adjacent said passageway.

10. The guitar strap connector of claim 7 wherein said void spaces extend to a point adjacent said first hole which is between the generally vertically directed diameter of said first hole and the end portion of said first hole adjacent said passageway.

11. The guitar strap connector of claim 1 further comprising a raised rim surrounding said generally keyhole-shaped opening, said raised rim forming a part of said spring-like members (6, 7).

12. The guitar strap connector of claim 1 wherein said strap engaging means comprises an elongated slot (2).

* * * * *